US007509868B2

(12) United States Patent
Aoki et al.

(10) Patent No.: US 7,509,868 B2
(45) Date of Patent: Mar. 31, 2009

(54) LIQUID DETECTING DEVICE, LIQUID CONTAINER, AND LIQUID REFILLING METHOD

(75) Inventors: Yuji Aoki, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/962,626

(22) Filed: Dec. 21, 2007

(65) Prior Publication Data

US 2008/0148859 A1 Jun. 26, 2008

(30) Foreign Application Priority Data

Dec. 26, 2006 (JP) ..... 2006-350224
Jul. 10, 2007 (JP) ..... 2007-180754

(51) Int. Cl.
*B41J 2/175* (2006.01)

(52) U.S. Cl. ..... 73/723; 73/290 V; 347/85

(58) Field of Classification Search ..... 73/723, 73/290 V; 347/85
See application file for complete search history.

(56) References Cited

U.S. PATENT DOCUMENTS 7,424,824 B2 * 9/2008 Usui et al. ..... 73/290 V
2006/0137447 A1 * 6/2006 Usui et al. ..... 73/290 V
2007/0109368 A1 * 5/2007 Kimura ..... 347/86
2007/0186984 A1 * 8/2007 Kimura ..... 137/588
2007/0186985 A1 * 8/2007 Potter et al. ..... 137/596.16
2007/0190664 A1 * 8/2007 Kimura ..... 436/174
2007/0196241 A1 * 8/2007 Kimura ..... 422/102
2008/0198187 A1 * 8/2008 Aoki et al. ..... 347/7

FOREIGN PATENT DOCUMENTS

JP 2001-328280 A 11/2001
JP 2006-160371 A 6/2006

* cited by examiner

*Primary Examiner*—Andre J Allen
(74) *Attorney, Agent, or Firm*—Sughrue Mion, PLLC

(57) ABSTRACT

A liquid container includes; a liquid containing portion for containing liquid therein; a unit case, including a liquid inlet communicating with the liquid containing portion, a liquid outlet for supplying the liquid outside, a flexible diaphragm that covers an upper opening of the unit case and that is displaceable depending on liquid pressure between the liquid inlet and the liquid outlet; a movable member attached to the flexible diaphragm and that has a pair of shafts formed to protrude from opposite sides of the movable member; a sensor assembly attached to a bottom opening formed in a bottom plate of the unit case and used for detecting that the liquid in the liquid containing portion is exhausted to a predetermined amount; and a pair of shaft receiving portions that is provided on the unit case for receiving the pair of the shafts to fix the movable member in a predetermined position in an initial state where the liquid has not flowed from the liquid inlet to the detection portion.

15 Claims, 13 Drawing Sheets

LIQUID DETECTING DEVICE, LIQUID CONTAINER, AND LIQUID REFILLING METHOD

BACKGROUND

1. Technical Field

The present invention relates to a liquid detecting device, a liquid container, and a liquid refilling method suitable for detecting the amount of remaining ink in an ink cartridge.

2. Related Art

A technique of detecting the amount of remaining liquid in an ink cartridge or the like by using a piezoelectric detecting means is known (refer to Patent Document 1). In this technique, a sensor chip which constitutes a piezoelectric detecting means has a sensor cavity and an electrical property of the piezoelectric detecting means changes depending on existence of liquid in the sensor cavity, thereby detecting an ink end or an ink near end.

Patent Document 1: JP-A-2006-160371 (0056-0057, 0076)

Unlike the technique disclosed in Patent Document 1, in order to perform detection of an ink end and an ink near end in a condition where liquid is filled in the sensor cavity all the time, erroneous detection occurs if ink is not reliably filled in a sensor cavity of a device for detecting the amount of remaining ink at an initial stage when the ink is introduced.

SUMMARY

An advantage of some aspects of one embodiment of the invention is to provide a liquid detecting device, a liquid container, and a liquid refilling method allowing liquid to be reliably filled in a detection space portion at an initial stage when liquid is introduced by precisely setting the positional relationship between a liquid detection chamber and a movable member including a pressure receiving plate that moves within the liquid detection chamber. The advantage can be attained by at least one of the following aspects:

A first aspect of the invention provides a liquid detecting device comprising: a liquid detection chamber which includes a liquid inlet, a liquid outlet, a flexible diaphragm that is displaced depending on liquid pressure between the liquid inlet and the liquid outlet, and a detection-portion-mounted member having one surface facing the diaphragm, and a volume of which changes with the liquid pressure; a movable member provided within the liquid detection chamber; a detection portion which is provided on the other surface of the detection-portion-mounted member and which includes a detection space portion that communicates with the liquid detection chamber and is separated from the liquid detection chamber by the detection-portion-mounted member, and a piezoelectric sensor that applies vibration to the detection space portion to detect a remaining vibration waveform according to the vibration; and a biasing member which biases the movable member movably toward the detection-portion-mounted member. The movable member has a pressure receiving plate and two shafts formed to protrude from the pressure receiving plate, and the pressure receiving plate is attached to the diaphragm and faces the one surface of the detection-portion-mounted member. The diaphragm expands until a volume of the liquid detection chamber reaches a predetermined volume when the liquid pressure is a predetermined value, such that the pressure receiving plate is spaced apart from the one surface of the detection-portion-mounted member against a biasing force of the biasing member. The movable member causes the pressure receiving plate to come in contact with the one surface of the detection-portion-mounted member at an initial stage where liquid is introduced into the liquid detection chamber, and the diaphragm to be displaced to a position at which the volume of the liquid detection chamber is smaller than the predetermined volume at liquid detection time at which the liquid pressure becomes smaller than the predetermined value, by the biasing force of the biasing member. The movable member further includes a first passage, which guides the liquid from the liquid inlet to the detection space portion at the initial stage, and a second passage, which guides the liquid from the detection space portion to the liquid outlet at the initial stage. The liquid detection chamber includes shaft receiving members, each of which is provided for positioning of each of the two shafts in a first direction of two perpendicular-axes directions of a two-dimensional plane parallel to the one surface of the detection-portion-mounted member, and facing members, each of which is positioned facing a front end surface of each of the two shafts in a second direction of the two perpendicular axes.

According to the aspect of the invention, a part of the movable member biased by the biasing member is attached to the flexible diaphragm. When the liquid pressure in the liquid detection chamber increases, the diaphragm expands to thereby increase the volume of the liquid detection chamber. As a result, the pressure receiving plate becomes spaced apart from the one surface of the detection-portion-mounted member against the biasing force of the biasing member. When the ink pressure becomes smaller than a predetermined value, the movable member is displaced by the biasing force of the biasing member. As a result, the pressure receiving plate is brought into contact with the one surface of the detection-portion-mounted member and the diaphragm is displaced to the position where the volume of the liquid detection chamber decreases. When the pressure receiving plate is spaced apart from the detection-portion-mounted member such that the detection space portion is opened to the ink detection chamber, attenuation of a remaining vibration waveform is small. On the other hand, when the pressure receiving plate is brought into contact with the detection-portion-mounted member such that the detection space portion is blocked, attenuation of the remaining vibration waveform is large. Through the difference described above, liquid detection, such as the amount of remaining liquid and the pressure of liquid, based on the position of the movable member becomes possible.

Here, positioning of the pressure receiving plate on a two-dimensional plane is performed such that the two shafts of the pressure receiving plate are regulated by the shaft receiving member in the first direction and the front end surfaces of the two shafts of the pressure receiving plate are positioned by the facing member in the second direction perpendicular to the first direction. Accordingly, the pressure receiving plate is positioned within the liquid detection chamber. Particularly at an initial stage when liquid is introduced into the liquid detection chamber, the liquid can be reliably introduced into the detection space portion by the first and second passages formed in the movable member which is formed integrally with the pressure receiving plate.

In the liquid detecting device according to the aspect of the invention, the piezoelectric sensor may detect an amplitude value of the remaining vibration waveform on the basis of a distance between the piezoelectric sensor and the pressure receiving plate. The amount of remaining liquid or the pressure of liquid can be simply measured with high precision by measuring the amplitude of the remaining vibration waveform after a predetermined time has elapsed from excitation, for example, by comparison with a threshold value rather than counting the attenuation time of the remaining vibration waveform or the wave number thereof.

In the liquid detecting device according to the aspect of the invention, two through holes which communicate with the liquid detection chamber and the detection space portion, respectively, maybe formed in the detection-portion-mounted member. At an initial stage when liquid is introduced into the liquid detection chamber, it is possible to introduce liquid into the liquid detection chamber and to discharge bubbles generated in the detection space portion using the two through hole.

In the liquid detecting device according to the aspect of the invention, the movable member may include: an upstream-side member which is formed to extend from the pressure receiving plate toward the liquid inlet along the first direction of the two perpendicular axes; and a downstream-side member which is formed to extend from the pressure receiving plate toward the liquid outlet along the first direction of the two perpendicular axes. The first passage may be formed in the upstream-side member and the pressure receiving plate and may guide the liquid to the detection space portion through one through hole formed from the liquid inlet to the detection-portion-mounted member. In addition, the second passage may be formed in the downstream-side member and the pressure receiving plate and may guide the liquid to the liquid outlet through the other through hole formed from the detection space portion to the detection-portion-mounted member. In this manner, liquid can be reliably filled into the detection space portion at the initial stage when liquid is introduced into the liquid detection chamber due to a capillary phenomenon or an attraction effect in the first and second passages.

In the liquid detecting device according to the aspect of the invention, the liquid detection chamber may have a sealing surface which is in contact with the downstream-side member at the initial stage to thereby seal a part of the second passage.

By sealing the second passage of the downstream-side member of the movable member portion at the initial stage when liquid is introduced into the liquid detection chamber, the liquid can be reliably filled into the detection space portion due to the capillary phenomenon or the attraction effect in the first and second passages. In addition, it is possible to discharge bubbles generated in the detection space portion and to realize highly precise liquid detection by preventing the detection accuracy from deteriorating due to existence of bubbles.

In the liquid detecting device according to the aspect of the invention, the liquid detection chamber may have an opening, which exposes the detection-portion-mounted member so as to keep positioning thereof, formed at a central position of the liquid detection chamber. In addition, the two perpendicular axes may have an intersection point therebetween at a position matching the central position of the liquid detection chamber.

In this case, since the mounting accuracy of the pressure receiving plate and the detection-portion-mounted member with respect to the liquid detection chamber is improved, the reliability in which the detection space portion can be filled with liquid at an initial stage when liquid is introduced into the liquid detection chamber is improved.

In the liquid detecting device according to the aspect of the invention, the shaft receiving member may include two standing members which stand up from the ink detection chamber on both sides of each of the two shafts. The two standing members may be formed such that a base-end-side distance therebetween is smaller than a free-end-side distance therebetween. Each of the two shafts may be positioned at the base end side of each of the two standing members when the pressure receiving plate comes in contact with the one surface of the detection-portion mounted member.

By setting up the distance between the two standing members as described above, it is possible to improve the positional accuracy of the pressure receiving plate if needed when the pressure receiving plate comes in contact with the detection-portion-mounted member.

In the liquid detecting device according to the aspect of the invention, the front end surface of each of the two shafts may be curved. In this case, since the frictional resistance to the facing member is reduced, the movable member can move smoothly.

In the liquid detecting device according to the aspect of the invention, a recess in which the movable member is accommodated may be formed in the liquid detection chamber, and the facing member may be formed in a part of an inside wall that forms the recess. In this case, the facing member may be formed by making the inside wall flat by a predetermined width along the first direction of the two perpendicular axes. In this case, even if the movable member deviates in the first direction, the positional accuracy of the movable member in the second direction does not deteriorate.

A second aspect of the invention provides a liquid container including: a liquid containing body that contains liquid therein; and the above-described liquid detecting device which communicates with the liquid containing body and in which the liquid contained in the liquid containing body is supplied to the liquid inlet.

A third aspect of the invention provides a liquid refilling method for refilling the liquid containing body of the liquid container collected form a market after liquid contained in the liquid containing body is lead out, including: introducing liquid from the liquid outlet; causing the liquid to pass from the liquid outlet toward the liquid inlet in the liquid detection chamber, without passing through at least the second passage, while holding liquid which remains in the detection space portion at the time of collection; and refilling with liquid from the liquid inlet of the liquid detecting device toward the liquid containing body.

In the liquid detecting device of the collected liquid container, liquid remains in the detection space portion. Since ink remaining in the detection space portion is not in contact with air, there occurs no problem concerning deterioration of the ink. Accordingly, in the method described above, it is possible to refill ink in the liquid containing body by causing the ink to pass through the liquid detection chamber without filling ink in the detection space portion at the time of refilling ink.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of the invention will be described. In addition, the present embodiment to be described below does not unduly limit the contents of the invention as defined in the appended claims, and all constituent elements described in the present embodiment are not necessarily indispensable as a solving means of the invention.

(Outline of a Liquid Ejecting Apparatus)

Figure 1:
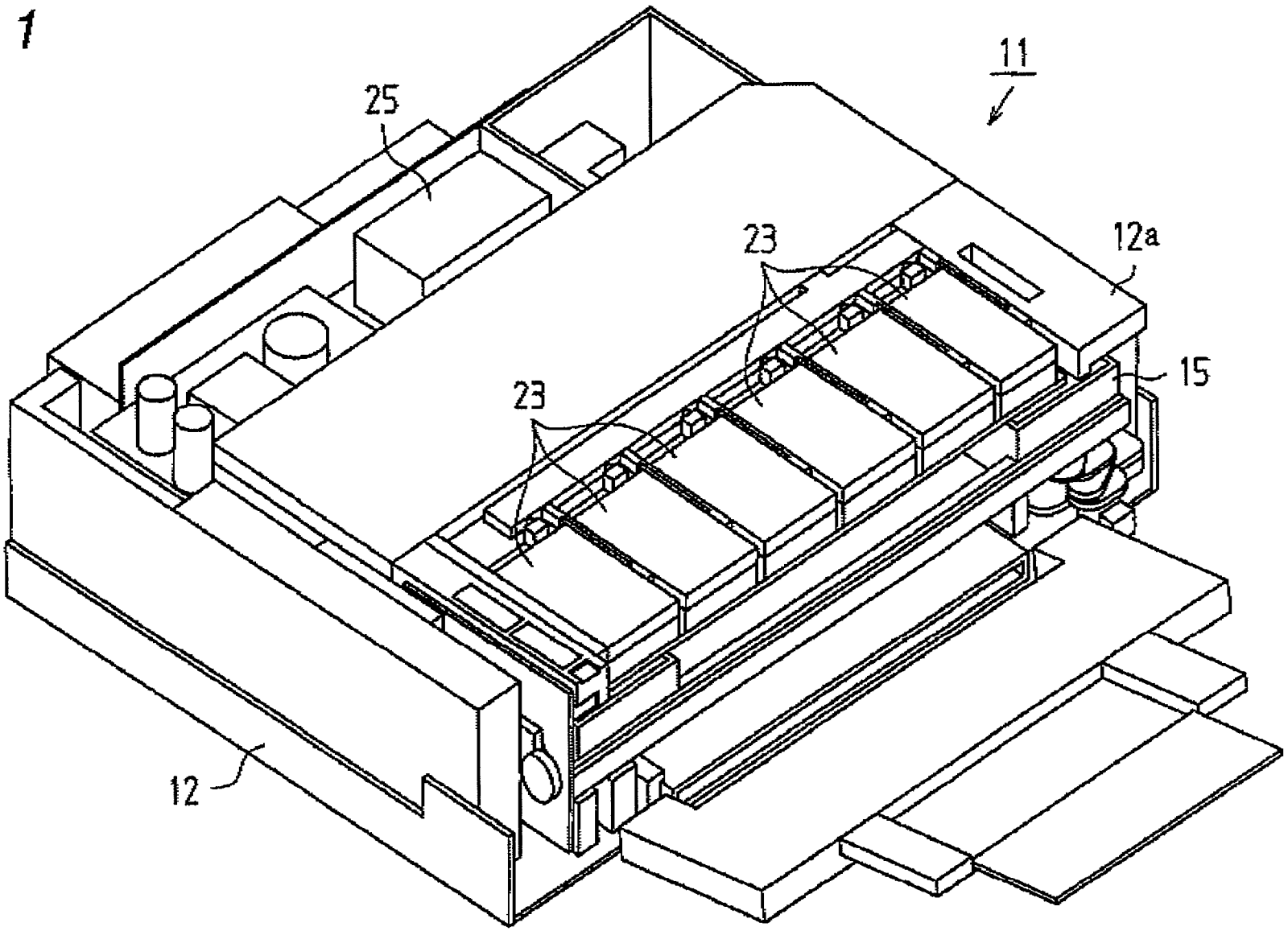
FIG. 1 is a perspective view illustrating a printer according to an embodiment of the invention.

As shown in FIG. 1, a printer 11 as a liquid ejecting apparatus according to the present embodiment is covered with a frame 12. In addition, as shown in FIG. 2, a guide shaft 14, a carriage 15, a recording head 20 serving as a liquid ejecting head, a valve unit 21, an ink cartridge 23 (refer to FIG. 1) serving as a liquid containing body, and a pressure pump 25 (refer to FIG. 1) are provided inside the frame 12.

As shown in FIG. 1, the frame 12 is a housing having an approximately rectangular parallelepiped shape, and a cartridge holder 12*a* is formed on a front surface.

Figure 2:
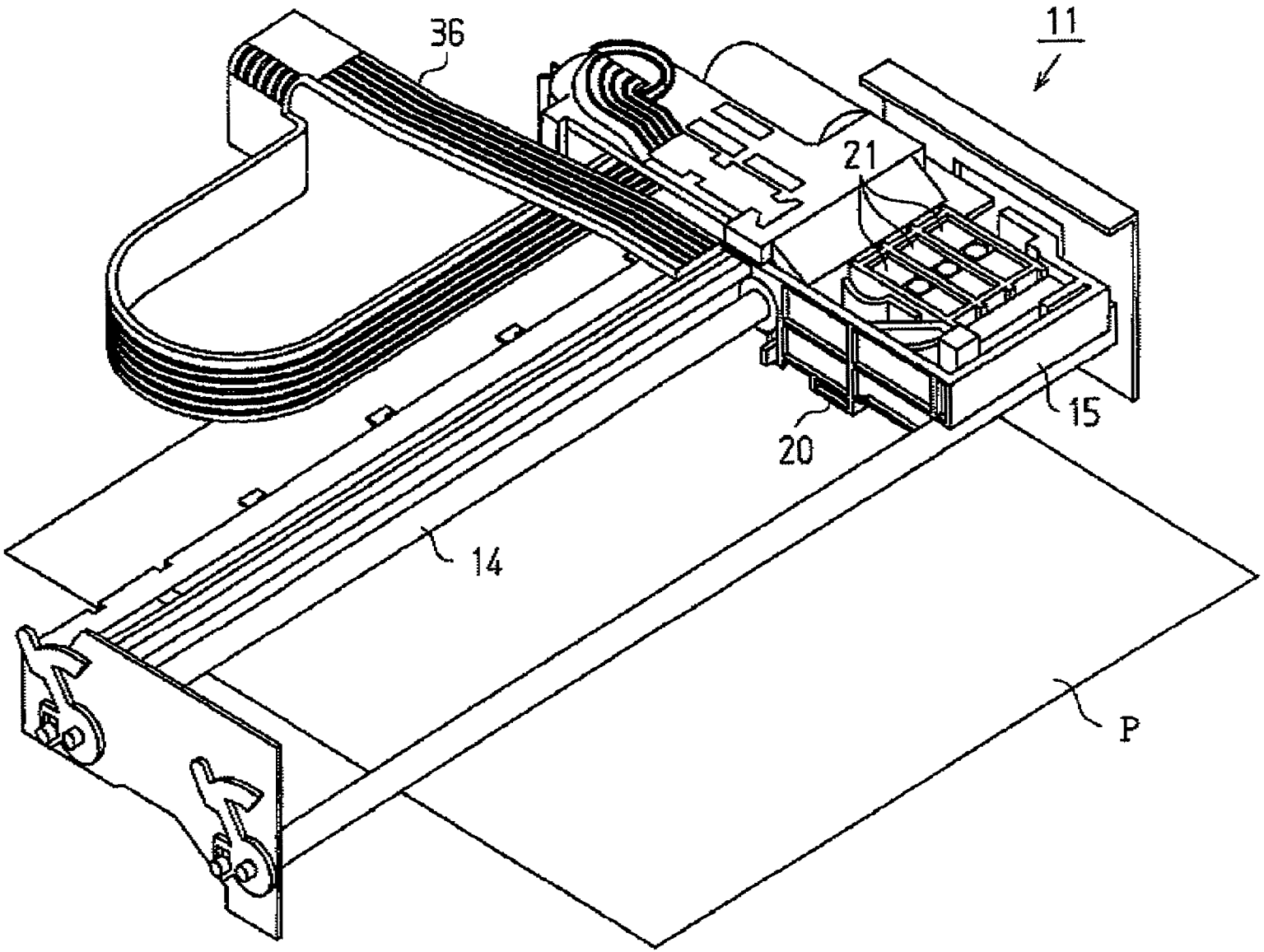
FIG. 2 is an exploded perspective view illustrating the printer shown in FIG. 1.

As shown in FIG. 2, the guide shaft 14 is formed in a cylindrical shape and provided within the frame 12. In addition, in the present embodiment, the direction in which the guide shaft 14 is provided is assumed to a main scanning direction. The guide shaft 14 is inserted through the carriage 15 such that the carriage 15 can move relatively with respect to the guide shaft 14, and the carriage 15 can reciprocate in the main scanning direction. In addition, the carriage 15 is connected to a carriage motor (not shown) through a timing belt (not shown). The carriage motor is supported by the frame 12. When the carriage motor is driven, the carriage 15 is driven through the timing belt, in such a manner that the carriage 15 reciprocates along the guide shaft 14, that is, in the main scanning direction.

The recording head 20 provided on a bottom surface of the carriage 15 includes a plurality of nozzles (not shown) used to make ink as liquid ejected therethrough. In addition, the recording head 20 performs recording of print data, such as an image or a character, by discharging ink droplets on a print medium, such as recording paper. The valve unit 21 is mounted on the carriage 15 and serves to supply ink, which is temporarily stored, to the recording head 20 in a condition where the pressure is adjusted.

Moreover, in the present embodiment, the valve unit 21 can supply one or two kinds of ink to the recording head 20 separately in a condition where the pressure is adjusted. Furthermore, in the present embodiment, three valve units 21 are provided corresponding to six ink colors (black, yellow, magenta, cyan, light magenta, light cyan).

In addition, a platen (not shown) is provided below the recording head 20. This platen supports a recording medium serving as a target which is fed in the sub-scanning direction perpendicular to the main scanning direction by a paper feeding means (not shown).

(Liquid Container)

Figure 3:
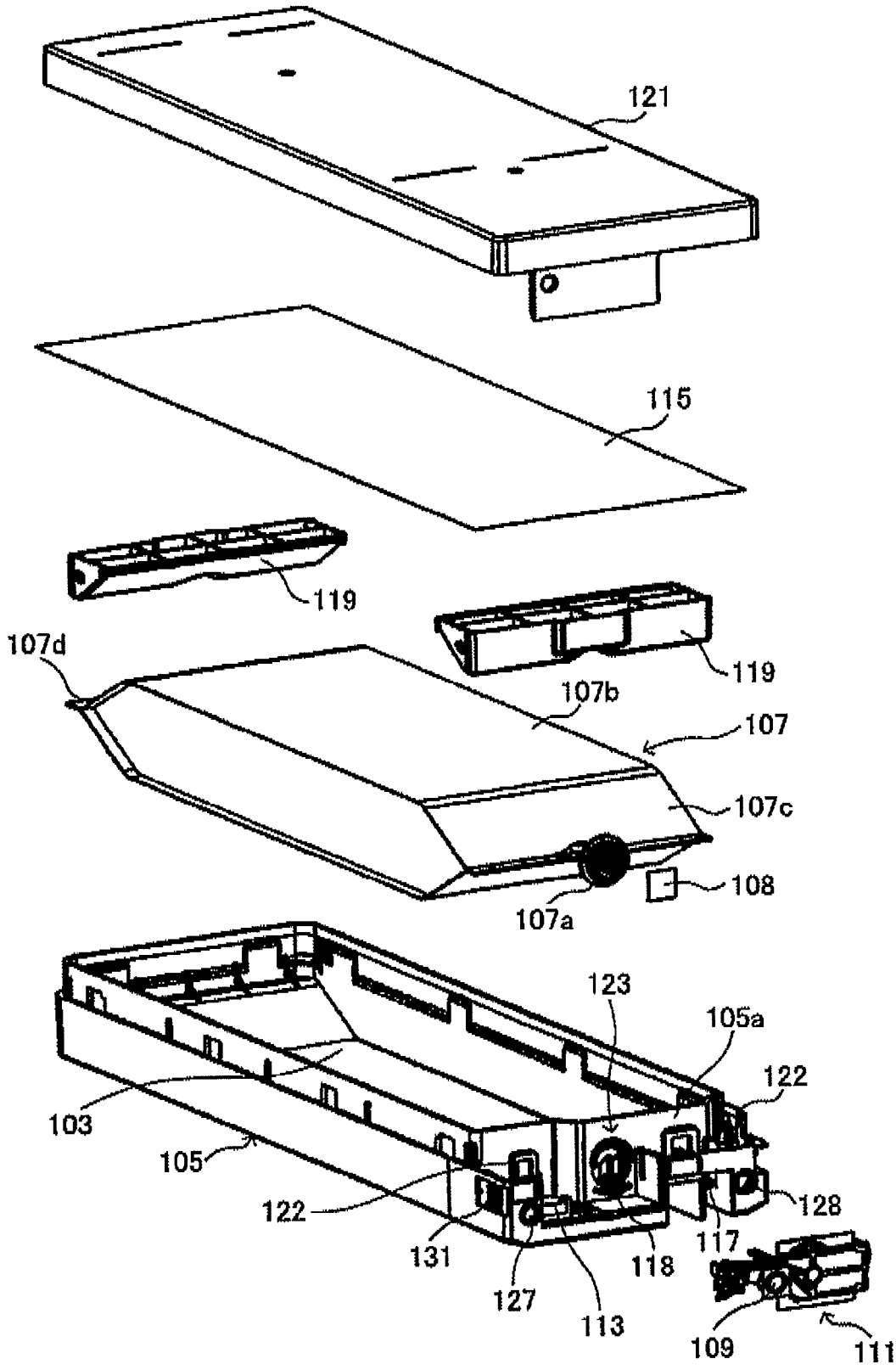
FIG. 3 is an exploded perspective view illustrating an ink cartridge shown in FIG. 1.

FIG. 3 is an exploded perspective view illustrating an ink cartridge as one exemplary embodiment of a liquid container. An ink cartridge 100 shown in FIG. 3 is detachably mounted in a cartridge mounting portion of an ink jet type recording apparatus for commercial use and supplies ink to a recording head (liquid ejecting head) provided in the recording apparatus.

The ink cartridge 100 includes; a container body 105 in which a pack accommodating section 103 pressurized by a pressure means is separately formed; an ink pack 107 serving as a liquid containing portion which stores ink therein, is accommodated in the pack accommodating section 103, and discharges stored ink from an ink lead-out member (liquid lead-out section) 107*a* by pressure of the pack accommodating section 103; and a liquid detecting unit 111 which has a liquid lead-out member 109 serving to supply ink to a recording head, which is an external liquid consuming apparatus, and is detachably mounted in the container body 105.

The container body 105 is a housing formed by resin molding. In the container body 105, the approximately box-shaped pack accommodating section 103 whose upper part is open and a detection unit accommodating section 113, which is located on a front surface side of the pack accommodating section 103 and accommodates the liquid detecting unit 111 therein, are formed so as to be separated from each other. The liquid detecting unit 111 is accommodated in the detection unit accommodating section 113.

An open surface of the pack accommodating section 103 is sealed with a sealing film 115 after the ink pack 107 is accommodated in the pack accommodating section 103. Thus, the pack accommodating section 103 becomes a sealed chamber.

A pressure port 117 serving as a communicating path used to apply pressure air inside the pack accommodating section 103, which is formed as a sealed chamber by the sealing film 115, is provided in a partition wall 105*a* which separates the pack accommodating section 103 from the detection unit accommodating section 113. When the ink cartridge 100 is mounted in a cartridge mounting portion of an ink jet type recording apparatus, a pressure air supplying means on a side of the cartridge mounting portion is connected to the pressure port 117. Accordingly, it becomes possible to pressurize the ink pack 107 with pressurized air supplied to the inside of the pack accommodating section 103.

The ink pack 107 is obtained by bonding the cylindrical ink lead-out member 107*a*, to which a connection pin 111*a* (refer to FIG. 5B) of the liquid detecting unit 111 is inserted and connected, to one end of a flexible bag 107*b* formed of a sealing film having a plurality of layers.

(Liquid Detecting Unit)

Figure 4:
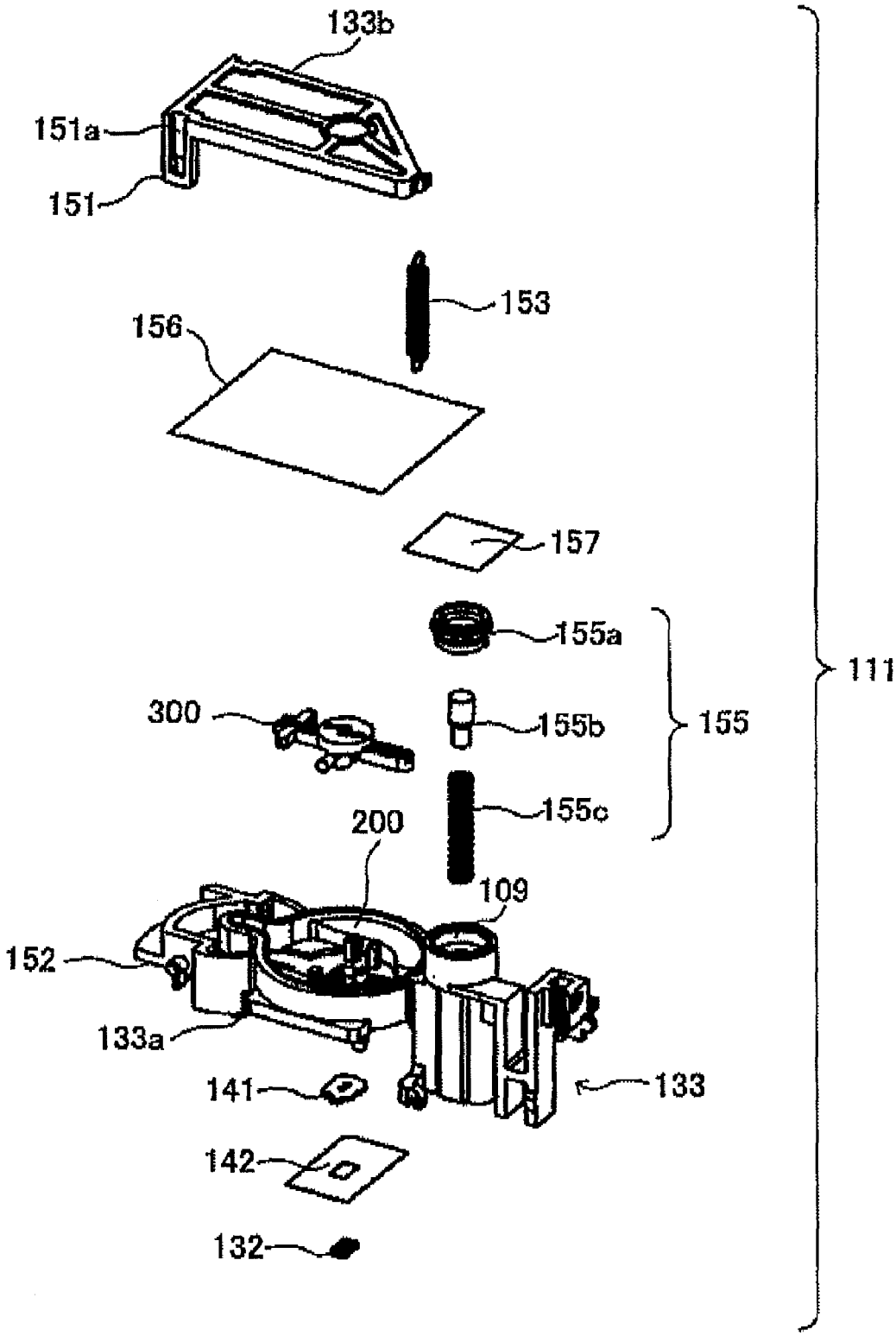
FIG. 4 is an exploded perspective view illustrating a liquid detecting unit.
Figure 5A:
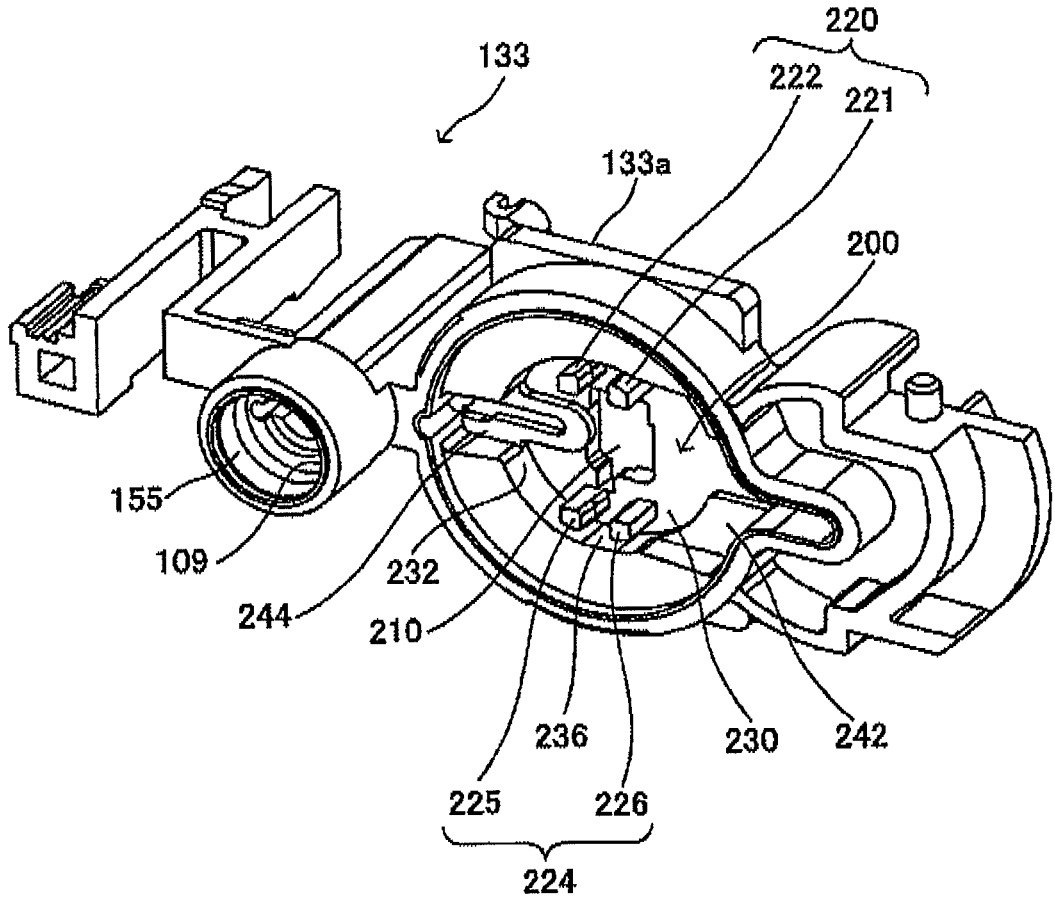
FIGS. 5A and 5B are perspective views schematically illustrating a case body of the liquid detecting unit.
Figure 5B:
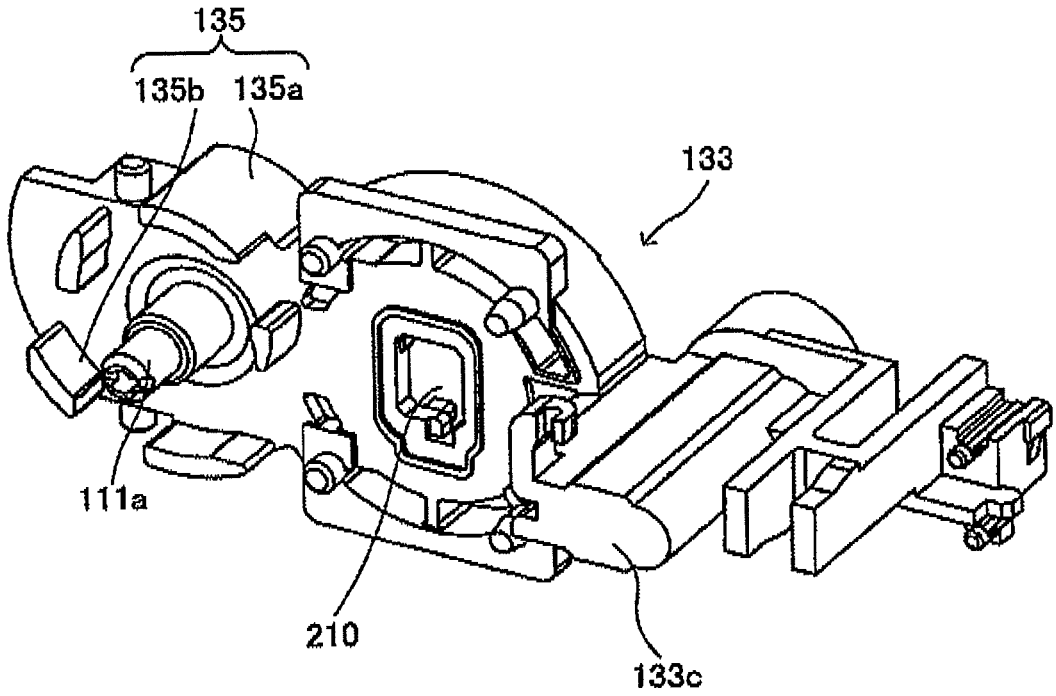

In the present embodiment, as shown in FIGS. 4, 5A, and 5B, the liquid detecting unit 111 includes: a unit case 133 which is attached to the container body 105 by a rotation operation and is formed of a resin; a sensor member 132 which is fixed on a bottom surface side of the unit case 133 through a sensor base 141 interposed therebetween; and an insulating sensor sealing film 142 which covers a surface of the sensor base 141 around the sensor member 132.

The unit case 133 is provided with an ink lead-out member 109, to which an ink supply pin (liquid lead-out pin) on a side of the cartridge mounting portion is inserted and connected, and a case body 133*a* having an ink detection chamber (liquid detection chamber) 200 communicating with the ink lead-out member 109. In the ink detection chamber 200, a movable member 300 shown in FIG. 4 is provided so as to be able to be displaced. In addition, a sealing film (diaphragm) 156, which covers a pressure chamber for detection of a remaining amount by sealing an open surface of the ink detection chamber 200, and a lid 133*b* which covers and protects the sealing film 156 are provided.

The lid 133*b* is rotatably connected to the case body 133*a* by fitting an engagement shaft 152, which protrudes toward the outer periphery of the case body 133*a*, in a hole 151*a* of a locking piece 151 protruding toward a base end. In addition, the lid 133*b* is fixed to the case body 133*a* by connecting a front end to the case body 133*a* using a spring (biasing member) 153.

A passage opening and closing mechanism 155, which causes a passage to be opened when an ink supply pin on a side of the cartridge mounting portion is inserted, is mounted in the ink lead-out member 109. The passage opening and closing mechanism 155 is configured to include a cylindrical sealing member 155*a* fixed to the ink lead-out member 109, a valve body 155*b* which is put into the sealing member 155*a* to thereby maintain the passage in a closed state, and a spring member 155*c* which biases the valve body 155*b* in the direction where the valve body 155*b* is put into the sealing member 155*a*.

An opening end of the ink lead-out member 109 in which the passage opening and closing mechanism 155 is mounted is sealed with a sealing film 157 (refer to FIG. 4). The sealing film 157 is welded to an opening end surface of the ink lead-out member 109 and an end surface of the sealing member 155*a* mounted in the ink lead-out member 109.

When the ink cartridge 100 is mounted in a cartridge mounting portion of a recording apparatus, an ink supply pin provided in the cartridge mounting portion breaks through the sealing film 157 to be inserted into the liquid lead-out member 109. At this time, since the ink supply pin inserted in the liquid lead-out member 109 causes the valve body 155*b* to separate from the sealing member 155*a*, the passage within the unit case 133 can communicate with the ink supply. As a result, supply of ink to the recording apparatus becomes possible.

Furthermore, as shown in FIG. 5B, the case body 133*a* has a container fitting portion 135, which is provided at a rear surface side of the case body 133*a*, at the position corresponding to a mounting portion 123 (refer to FIG. 3) of the container body 105, the container fitting portion 135 rotatably fitting in the mounting portion 123. At an inner side of the container fitting portion 135, the connection pin 111*a* which is inserted and connected to the ink lead-out member 107*a* of the ink pack 107 is provided. The connection pin 111*a* breaks through a sealing film 108 shown in FIG. 3 and is then inserted into the ink lead-out member 107*a*. Then, a valve mechanism in the ink lead-out member 107*a* is opened. As a result, ink can be lead out.

The sensor member 132 outputs as an electrical signal a change of remaining vibration occurring according to a change of an ink flow rate (pressure) by using a piezoelectric detecting means which is fixed to a bottom surface side of the case body 133*a* such that vibration can be applied to a sensor cavity (inspection space portion) 132A, which will be described in FIGS. 7 and 15. A control circuit on a side of a recording apparatus analyzes the output signal of the sensor member 132, and thus the amount of remaining ink in the ink pack 107 is detected.

(Detection Portion)

Figure 6:
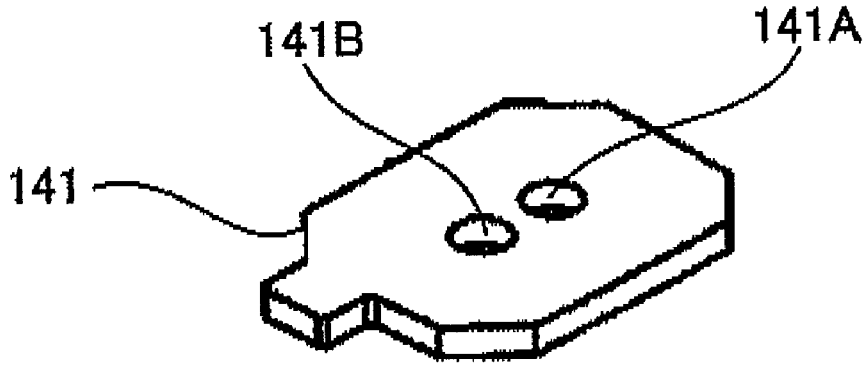
FIG. 6 is a perspective view illustrating a sensor base as viewed from a back side.

FIG. 6 is a perspective view illustrating a sensor base (detection-portion-mounted member) 141 as viewed from the below. As shown in FIG. 6, a first through hole (supply passage) 141A and a second through hole (discharge passage) 141B which pass through the sensor base 141 in the thickness direction of the sensor base 141 are provided in the sensor base 141. The sensor base 141 is formed of SUS, for example.

Figure 7:
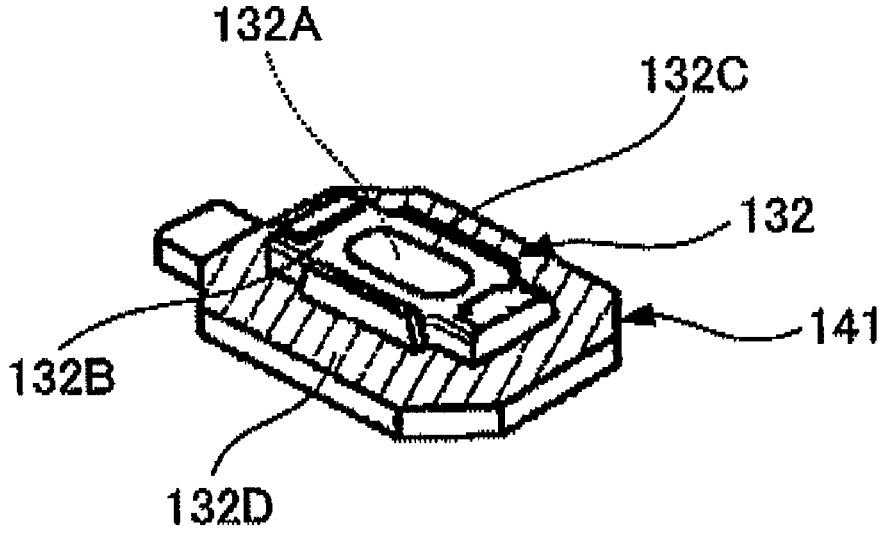
FIG. 7 is a perspective view illustrating a sensor base on which a sensor chip is mounted as viewed from a front side.

FIG. 7 is a perspective view illustrating the sensor base 141 mounted with the sensor member 132 as viewed from the above. Referring to FIG. 7, the sensor member 132 has the sensor cavity (inspection space portion) 132A (positioned below 132B and 132C in FIG. 7) that receives ink (liquid) to be detected, and the sensor cavity 132A communicates with the first and second through holes 141A and 141B of the sensor base 141. A top surface of the sensor cavity 132A is blocked by a vibrating plate 132B. In addition, a piezoelectric element 132C is arranged on a top surface of the vibrating plate 132B.

For example, the piezoelectric element 132C has a function of determining an ink end by applying vibration to the sensor cavity 132A and detecting a remaining vibration waveform according to the vibration. As materials of a piezoelectric layer, a zirconate titanate (PZT), a lead lanthanum zirconate titanate (PLZT), a leadless piezoelectric film that does not contain lead, and the like may be used.

The sensor member 132 is integrally fixed to the sensor base 141 with an adhesive 132D by placing a bottom surface of a chip body in the middle of a top surface of the sensor base 141, and at the same time, the sensor base 141 and the sensor member 132 are sealed by the adhesive 132D.

(Detection Chamber and Movable Member)

Figure 8:
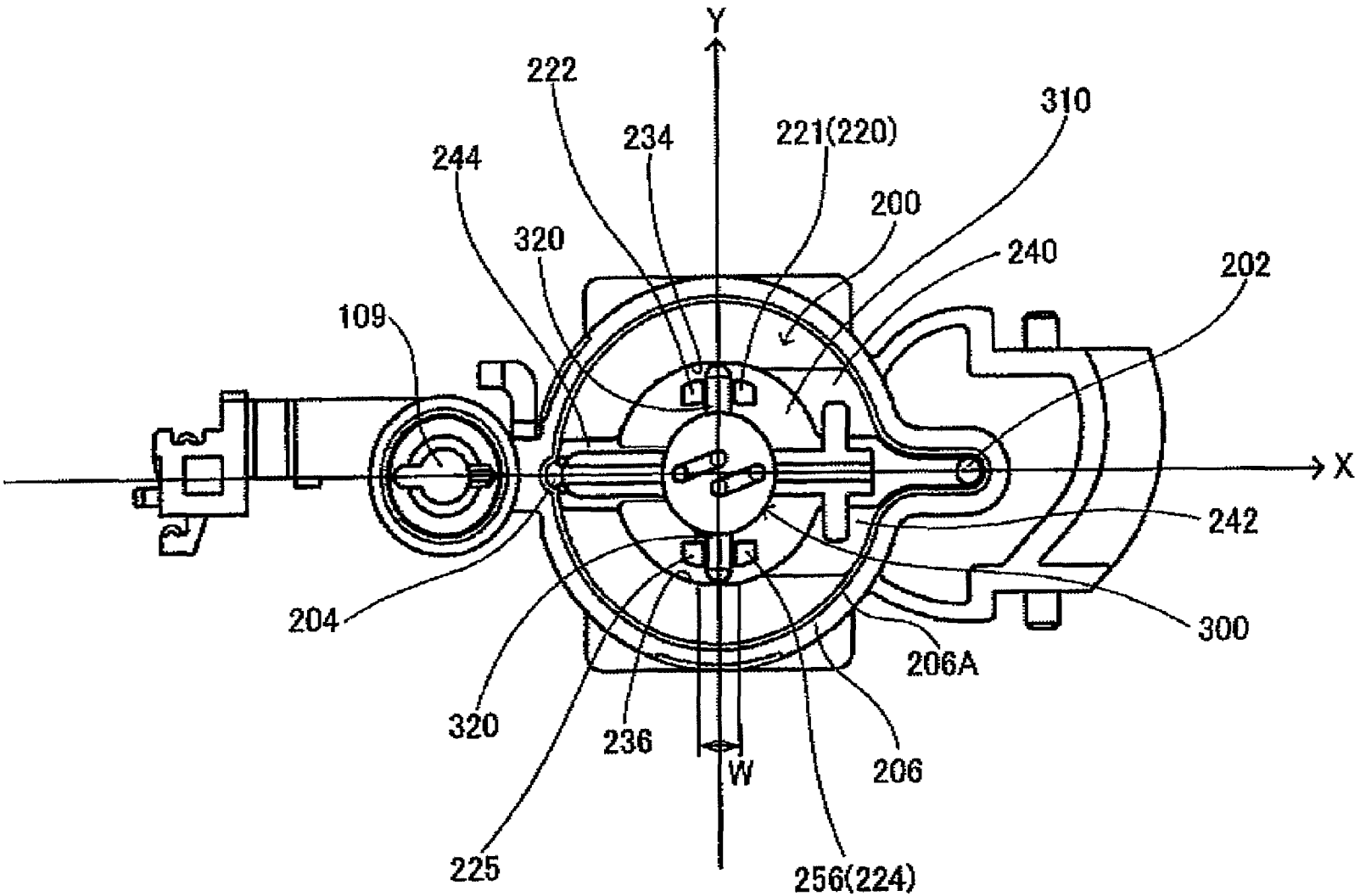
FIG. 8 is a plan view illustrating an ink detection chamber.
Figure 9:
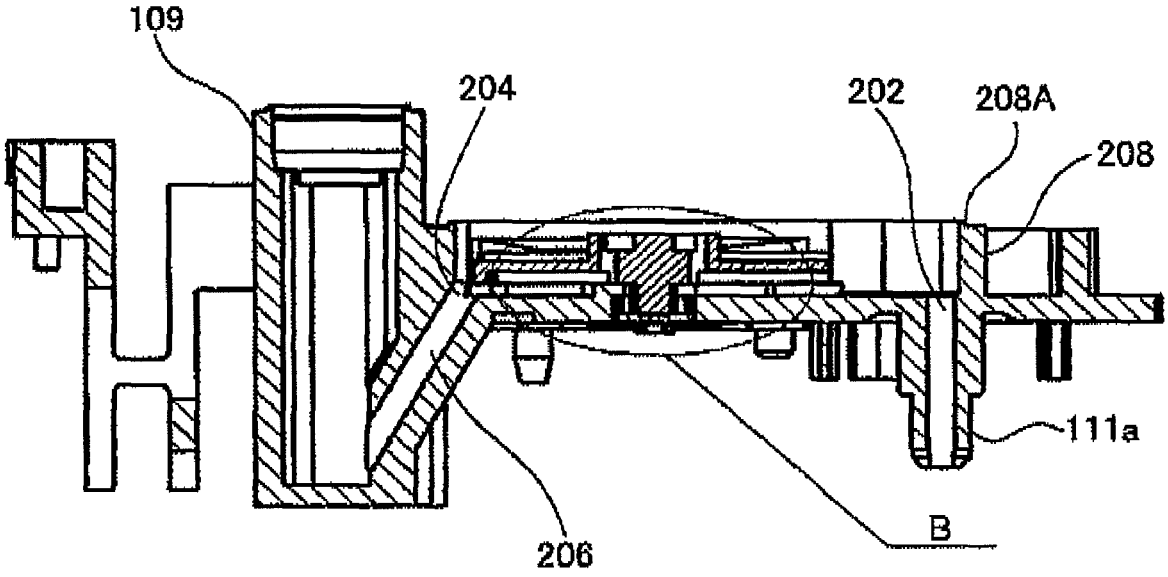
FIG. 9 is a cross-sectional view taken along a Y axis of FIG. 8.
Figure 10:
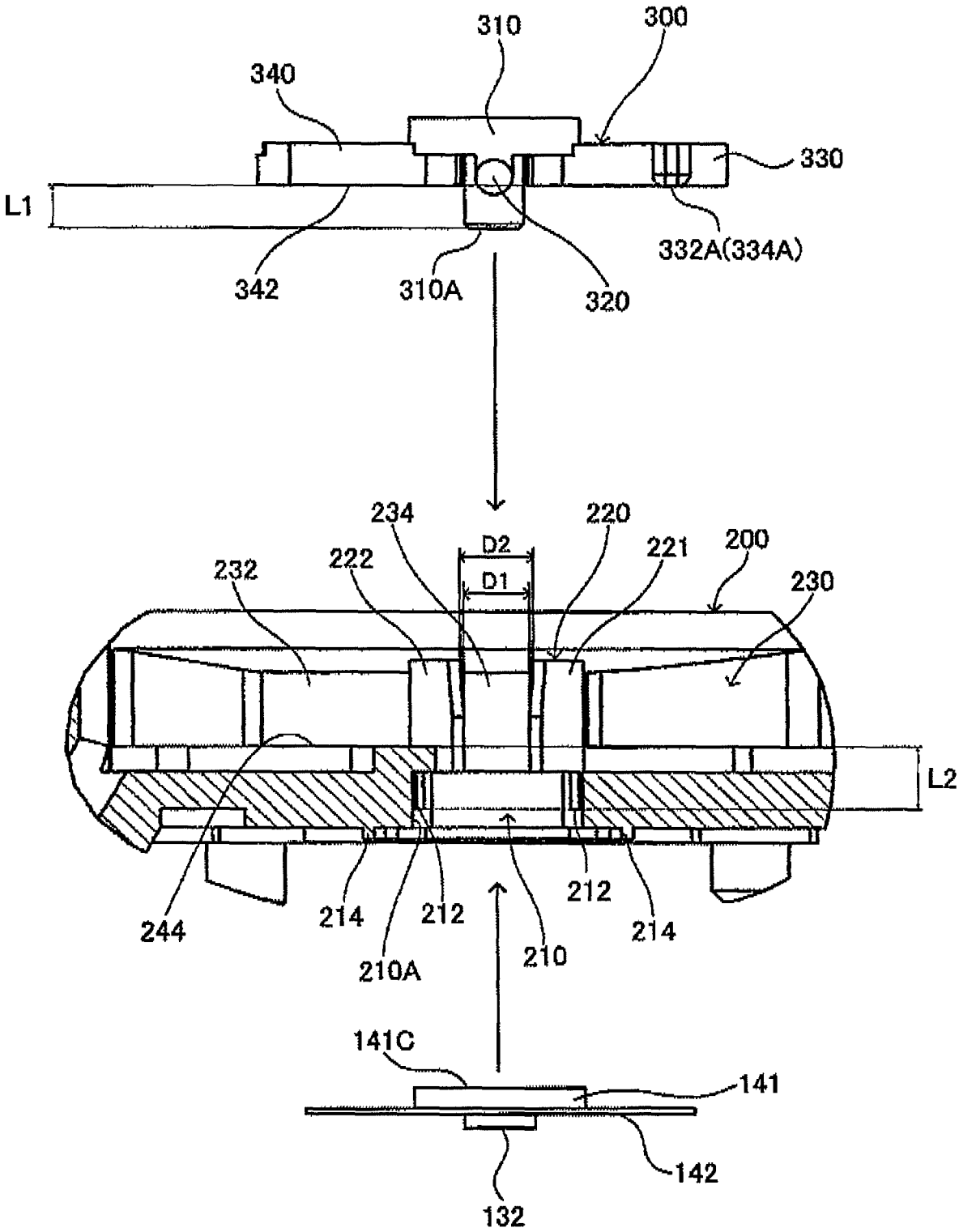
FIG. 10 is an explanatory view schematically illustrating attachment of a movable member, a sensor base, and a detection portion to an ink detection chamber.

FIG. 8 is a plan view illustrating a state in which the movable member 300 is arranged in the ink detection chamber 200. FIG. 9 is a cross-sectional view taken along the X-axis direction of FIG. 8. FIG. 10 illustrates the sensor member (detection portion) 132 and the movable member 300 arranged in the ink detection chamber 200.

Openings for an ink inlet (liquid inlet) 202 and an ink outlet (liquid outlet) 204 are formed in the ink detection chamber 200. The ink inlet 202 communicates with an ink lead-out pin 111*a* shown in FIG. 9. The ink outlet 204 communicates with the ink lead-out member 109 through an inclined passage 206, as shown in FIG. 9.

A welding rib 208A is formed on an end surface of a circumferential wall 208 which partitions the ink detection chamber 200. The flexible diaphragm 156 (refer to FIG. 4) is welded to the welding rib 208A. The ink detection chamber 200 blocked by the diaphragm 156 forms a pressure chamber, such that the diaphragm 156 is displaced according to ink pressure between the ink inlet 202 and the ink outlet 204.

At the middle position of the ink detection chamber 200, an opening 210 in which the sensor base (detection-portion-mounted member) 141 shown in FIG. 10 is arranged so as to face the opening 210 is formed. As shown in FIG. 10, the sensor base 141 to which the sensor member (detection portion) 132 is fixed and the movable member 300 are arranged so as to face the opening 210. In addition, a lower end surface 310A of a pressure receiving plate 310, which is shown in FIG. 10, facing a surface 141C of the sensor base 141 is called a sensor cavity sealing surface (detection space portion sealing surface).

Figure 11:
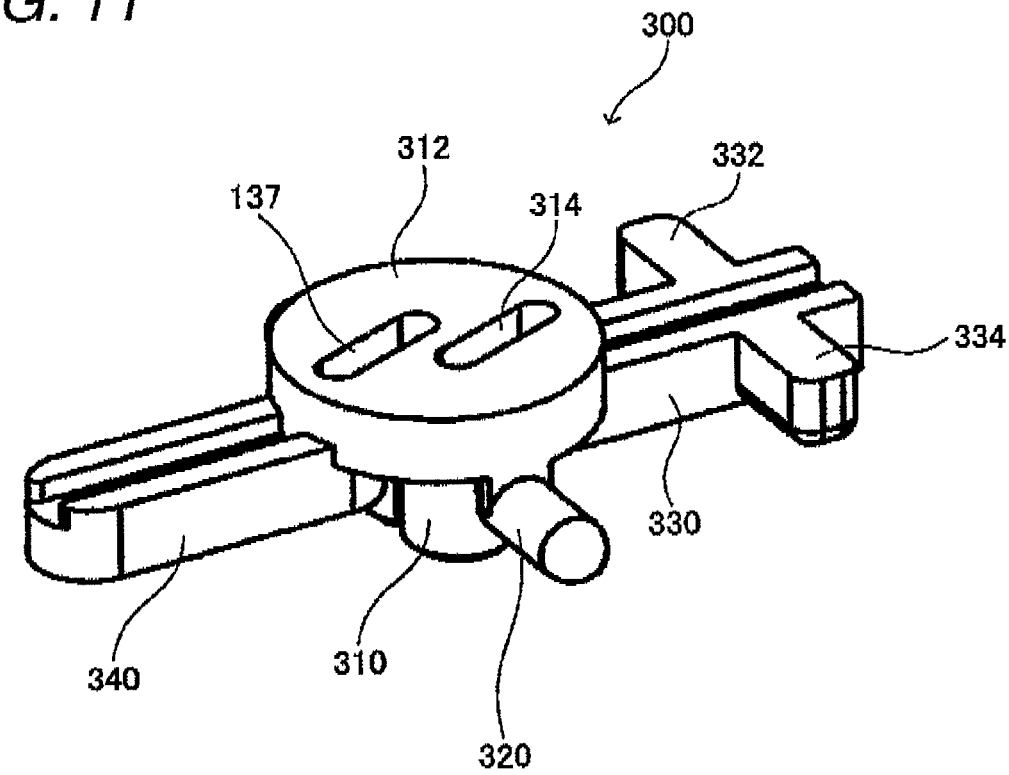
FIG. 11 is a perspective view schematically illustrating a movable member.
Figure 12:
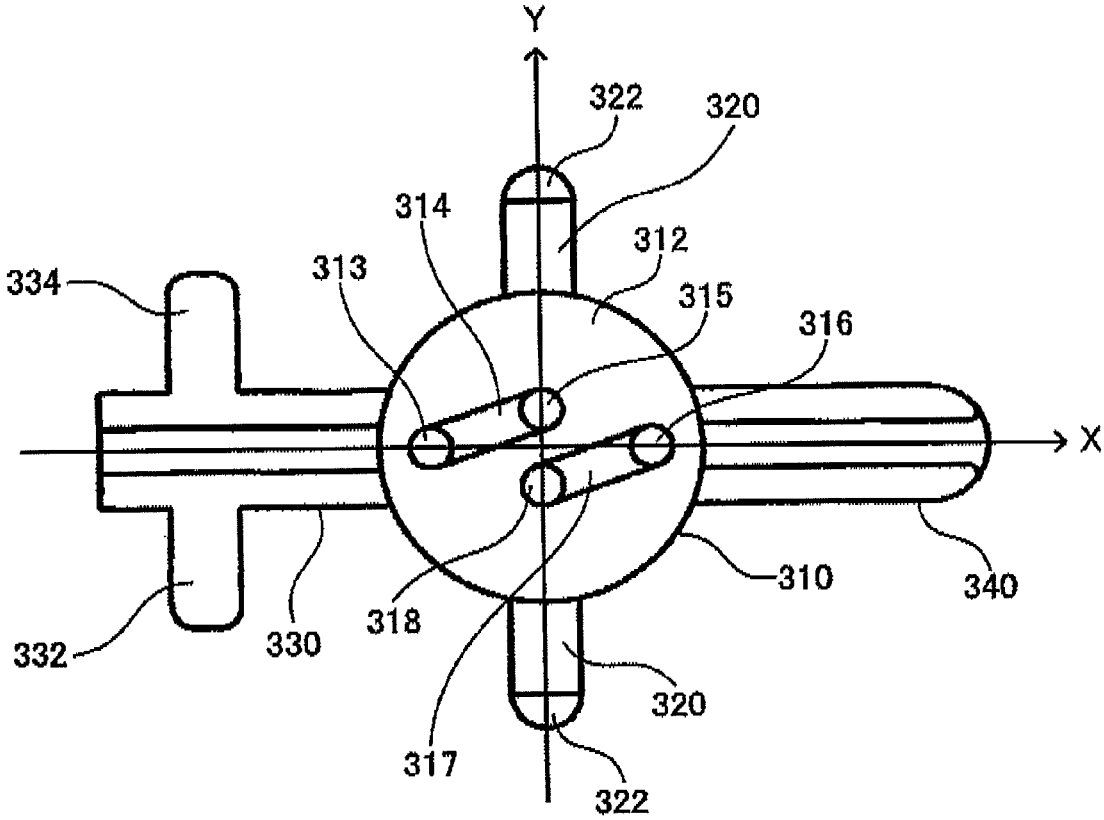
FIG. 12 is a plan view illustrating a movable member.
Figure 13:
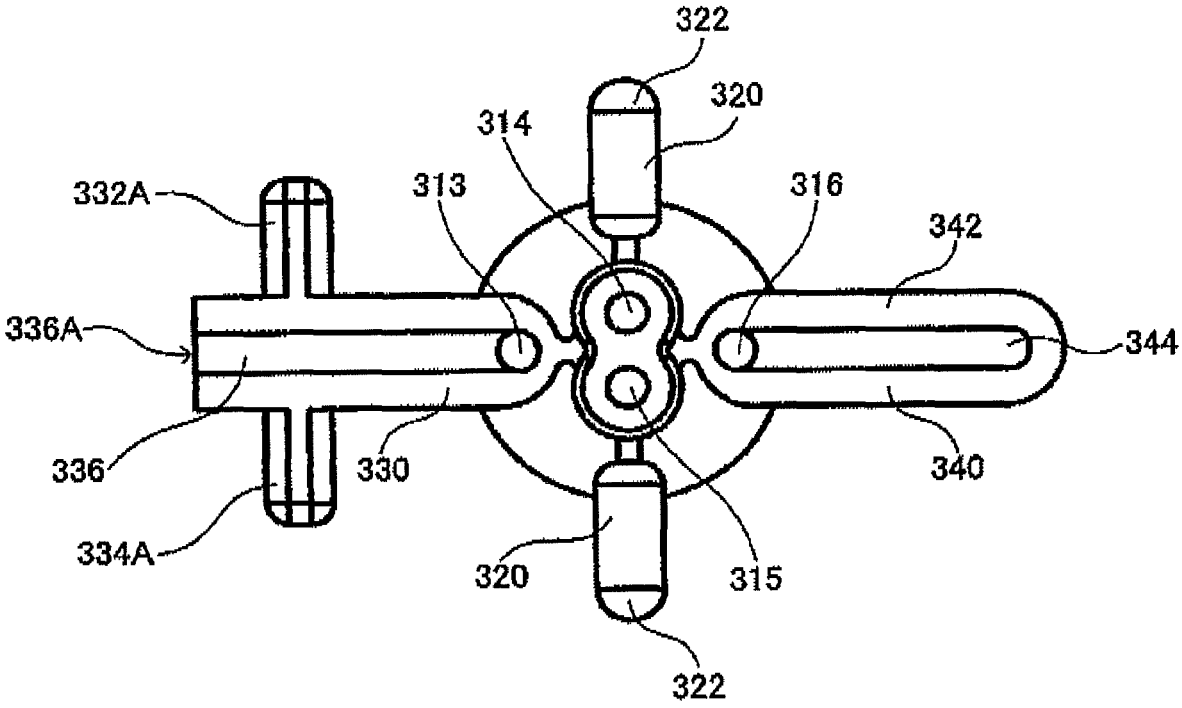
FIG. 13 is a view illustrating a bottom surface of a movable member.

FIG. 11 is a perspective view illustrating the movable member 300, FIG. 12 is a plan view illustrating the movable member 300, and FIG. 13 is a back side view illustrating the movable member 300. The movable member 300 includes the pressure receiving plate 310. An upper end surface 312 of the pressure receiving plate 310 is welded to the diaphragm 156.

Here, directions along two perpendicular axes having an intersection point at the center of the ink detection chamber 200 (center of the circular pressure receiving plate 310) are defined as X direction (first direction) and Y (second direction).

Two shafts 320 and 320 which extend from the pressure receiving plate 310 to both ends of the Y direction shown in FIG. 12 are provided in the movable member 300. A front end of each shaft 320 is formed in a curved shape, for example, a hemispherical surface 322. In addition, an upstream-side member 330 and a downstream-side member 340 which extend from the pressure receiving plate 310 to both ends of the X direction shown in FIG. 12 are provided.

The upstream-side member 330 has protrusions 332 and 334 which protrude toward both ends of a direction parallel to the Y direction shown in FIG. 12. Bottom surfaces 332A and 334A of the protrusions 332 and 334 become first and second height reference surfaces.

Furthermore, the upstream-side member 330 has a first groove passage 336 which communicates with an X-direction end opening 336A and extends in the X direction. An inside end of the first groove passage 336 communicates with a first through hole 313 formed in the pressure receiving plate 310. In addition, a second groove passage 314 is formed on an upper end surface 312 of the pressure receiving plate 310, and first and second through holes 313 and 315 are formed in the pressure receiving plate 310 so as to penetrate the pressure receiving plate 310 and face the second groove passage 314. In addition, the second groove passage 314 communicates with the first through hole 313 existing on an X axis and the second through hole 315 existing on a Y axis, which extend in the X and Y directions so as to cross each other.

A bottom surface 342 of the downstream-side member 340 serves as a third height reference surface and a first sealing surface.

The downstream-side member 340 has a second groove passage 344 formed on a bottom surface (first sealing surface) 342. An inside end of the second groove passage 344 communicates with a third through hole 316 formed in the pressure receiving plate 310. In addition, a fourth groove passage 317 is formed on the upper end surface 312 of the pressure receiving plate 310, and third and fourth through holes 316 and 318 are formed in the pressure receiving plate 310 so as to penetrate the pressure receiving plate 310 and face the fourth groove passage 317. In addition, the fourth groove passage 317 communicates with the third through hole 316 existing on the X axis and the fourth through hole 318 existing on a Y axis, which extend in the X and Y directions so as to cross each other.

Here, since the diaphragm 156 is welded to the upper end surface 312 of the pressure receiving plate 310, the second and fourth groove passages 314 and 317 are sealed by the diaphragm 156 in a liquid-tight manner. In addition, as shown in FIGS. 11 and 12, grooves are also formed on the upper end surfaces of the upstream-side and downstream-side members 330 and 340, but the grooves serve to prevent shrinkage at the time of injection molding.

The first and second groove passages 336 and 314 and the first and second through holes 313 and 315 formed in the upstream-side member 330 and the pressure receiving plate 310 described above are collectively called a first passage. Similarly, the third and fourth groove passages 344 and 317 and the third and fourth through holes 316 and 318 formed in the downstream-side member 340 and the pressure receiving plate 310 are collectively called a second passage. The first passage communicates with the first through hole (supply passage) 141A formed in the sensor base 141 shown in FIG. 6, and the second passage communicates with the second through hole (discharge passage) 141B formed in the sensor base 141 shown in FIG. 6.

At an initial stage when ink is introduced into the ink detection chamber 200, the first and second passages are formed. Accordingly, ink flows through the first passage, the first through hole 141A, the sensor cavity 132A (refer to FIG. 7), the second through hole 141B, and the second passage due to a capillary phenomenon, such that ink is filled in the sensor cavity 132A. In such a sense, the movable member 300 may also be called a passage forming member.

(Positioning of a Movable Member)

The positioning structure of the movable member 300 will be described with reference to FIG. 8. Moreover, in FIG. 8, an intersection point of the two perpendicular axes in the X and Y directions matches the position of a center of the ink detection chamber 200. As shown in FIG. 8, first and second bearings 220 and 224 for positioning the two shafts 320 and 320 of the pressure receiving plate 310 are provided in the ink detection chamber 200 (also refer to FIG. 5A). The first bearing 220 has two standing members 221 and 222 which stand up from the ink detection chamber 200 on both sides of one of the shafts 320. The second bearing 224 has two standing members 225 and 226 which stand up from the ink detection chamber 200 on both sides of the other shaft 320.

For example, FIG. 10 shows the first bearing 220. For a distance between the two standing members 221 and 222, a base-end-side distance D1 is set to be smaller than a free-end-side distance D2 (D1<D2). The size of the second bearing 224 is the same as that of the first bearing 220.

Here, the diameter of the shaft 320 of the pressure receiving plate 310 is slightly smaller than the size D1. Accordingly, positioning of the movable member 300 in the X direction shown in FIG. 8 is performed at the two shafts 320 of the pressure receiving plate 310 and the first and second bearings 220 and 224 which receive the two shafts 320 therein.

On the other hand, facing members 234 and 236 facing the front ends 322 of the two shafts 320 protruding from the pressure receiving plate 310 are provided in the ink detection chamber 200 in order to cause the movable member 300 to be positioned in the Y direction. Here, in the ink detection chamber 200, a recess 230 in which the movable member 300 is accommodated is formed, as shown in FIG. 5A. The facing members 234 and 236 are formed in a part of an inside wall 232 which forms the recess.

The inside wall surface 232 is a peripheral surface, but each of the facing members 234 and 236 formed in a part of the inside wall surface 232 are formed as a flat surface having a predetermined width W in the X direction shown in FIG. 8 (refer to FIG. 5A).

Thus, since each of the facing members 234 and 236 is a flat surface having the width W, a distance between the two facing members 234 and 236 is constant. Here, if there is a slight difference between the minimum distance D1 between the first and second bearings 220 and 224 and the diameter of the shaft 320, the movable member 300 is displaced in the X direction. However, if the difference is within a range of the width W, a deviation in the Y direction is within a fixed range.

Furthermore, since the front end surfaces 322 of the two shafts 320 of the pressure receiving plate are curved surfaces, for example, hemispherical surfaces, the front end surfaces 322 are in point contact with the facing members 234 and 236. For this reason, even if the movable member 300 is displaced while the front end surfaces 322 of the two shafts 320 of the pressure receiving plate are being in contact with the facing members 324 and 326, frictional resistance is extremely small. Therefore, displacement of the movable member 300 according to the ink pressure within the ink detection chamber 200 is not adversely affected.

Thus, the movable member 300 is positioned such that the center of the movable member 300 almost matches the intersection point of the two perpendicular axes X and Y, which is the center of the ink detection chamber 200. Consequently, the positional accuracy of the movable member 300 with respect to the ink detection chamber 200 is improved. The improvement in positional accuracy is very important in filling the sensor cavity 132A with ink at an initial stage when the ink is introduced into the ink detection chamber 200, and the reason will be described later.

Next, positioning of the movable member 300 in the height direction thereof will be described. As described above, the upstream-side member 330 of the movable member 300 has the protrusions 332 and 334, and the bottom surfaces 332A and 334A of the protrusions 332 and 334 serve as first and second height reference surfaces, respectively, as shown in FIGS. 10 and 13. In addition, the bottom surface 342 of the downstream-side member 340 of the movable member 300 serves as a third height reference surface and a first sealing surface.

On the other hand, the ink detection chamber 200 has first, second, and third height reference surfaces 240, 242, and 244 that are in contact with the first, second, and third height reference surfaces 332A, 334A, and 342 of the movable member 300, as shown in FIGS. 5A, 5B, and 8. Thus, since the movable member 300 abuts on the three surfaces 240, 242, and 244, the height positioning can be stably set.

Here, the bottom surface 342 of the downstream-side member 340 of the movable member 300 functions as a first sealing surface, and is in contact with the second sealing surface and the third height surface of the ink detection chamber 200 at an initial stage when ink is introduced into the ink detection chamber 200. As a result, the fourth groove passage 336 of the downstream-side member 340 of the movable member 300 is sealed. It is very important to seal the fourth groove passage 336 of the downstream-side member 340 in order to fill the sensor cavity 132A with ink on the basis of a capillary phenomenon at an initial stage. This is because the capillary phenomenon is inhibited if a sealing property of the first and second sealing surfaces 342 and 244 is not good, and as a result, ink flows through a passage other than the first and second passages of the movable member 300 described above. Once ink deviates from a passage, the first and second sealing surfaces 342 and 244 are not in contact with each other since the movable member 300 is displaced together with the diaphragm 156. Thus, the first and second sealing surfaces 342 and 244 are not in contact with each other at an initial stage. In this case, since the sensor cavity 132A is not filled with ink, the amount of remaining ink cannot be detected.

In such a sense, the improvement in positional accuracy of the movable member 300 with respect to the ink detection chamber 200 is very important in filling the sensor cavity 132A with ink at an initial stage when the ink is introduced into the ink detection chamber 200, which can be realized in the present embodiment.

In addition, the first and second sealing surfaces 342 and 244 may also be called bubble discharge sealing surfaces. That is, this is because bubbles remaining in the sensor cavity 132A, which is a detection space portion, can be easily removed due to the capillary phenomenon or an attraction effect if the first and second sealing surfaces 342 and 244 are surely sealed.

In addition, a sealing load by which the first and second sealing surfaces 342 and 244 are in contact with each other at the time of liquid detection and at an initial stage can be secured only by a biasing force of the biasing member 153 shown in FIG. 4. In this manner, it is not necessary to apply an external force other than the biasing member 153 particularly at an initial stage.

(Positioning of a Sensor Base and a Detection Portion)

Next, positioning of the sensor base (detection-portion-mounted member) 141 and the sensor chip (detection portion) 132 mounted on the sensor base 141, which are shown in FIG. 7, will be described.

As described above, the liquid detection chamber 200 has the opening 210 for exposing a surface of the sensor base 141. The opening 210 is provided with three contact surfaces 212 on which a surface of the sensor base 141 abuts. Positioning for the installation height of the sensor base 141 and the sensor member 132 is made when the surface of the sensor base 141 abuts on the contact surfaces 212.

In addition, the opening 210 of the liquid detection chamber 200 has an inner peripheral wall 210A which has a contour shape corresponding to the appearance of the sensor base 141. Moreover, welding portions 214 welded to the sealing film 142 is provided around the opening 210.

Positioning for the height of the sensor base 141 inserted in the opening 210 is made when the sensor base 141 abuts on the contact surfaces 212 of the opening 210 of the ink detection chamber 200, and positioning for a two-dimensional plane position of the sensor base 141 is made by the inner peripheral wall 210A. Since an intersection point of two-dimensional coordinates X and Y is set at the center of the opening 210, the center of the sensor member 132 mounted on the sensor base 141 is also set at the intersection point of the two-dimensional coordinates X and Y.

Here, in FIG. 10, a design value of a distance from the first sealing surface 342 to the sensor cavity sealing surface (detection space portion sealing surface) 310A in the pressure receiving plate 310 is set to L1. A distance from the second sealing surface 244 to the contact surface in the ink detection chamber 200 is set to L2. At this time, the following expression (1) is satisfied.

$$L1>L2 \quad (1)$$

Figure 14:
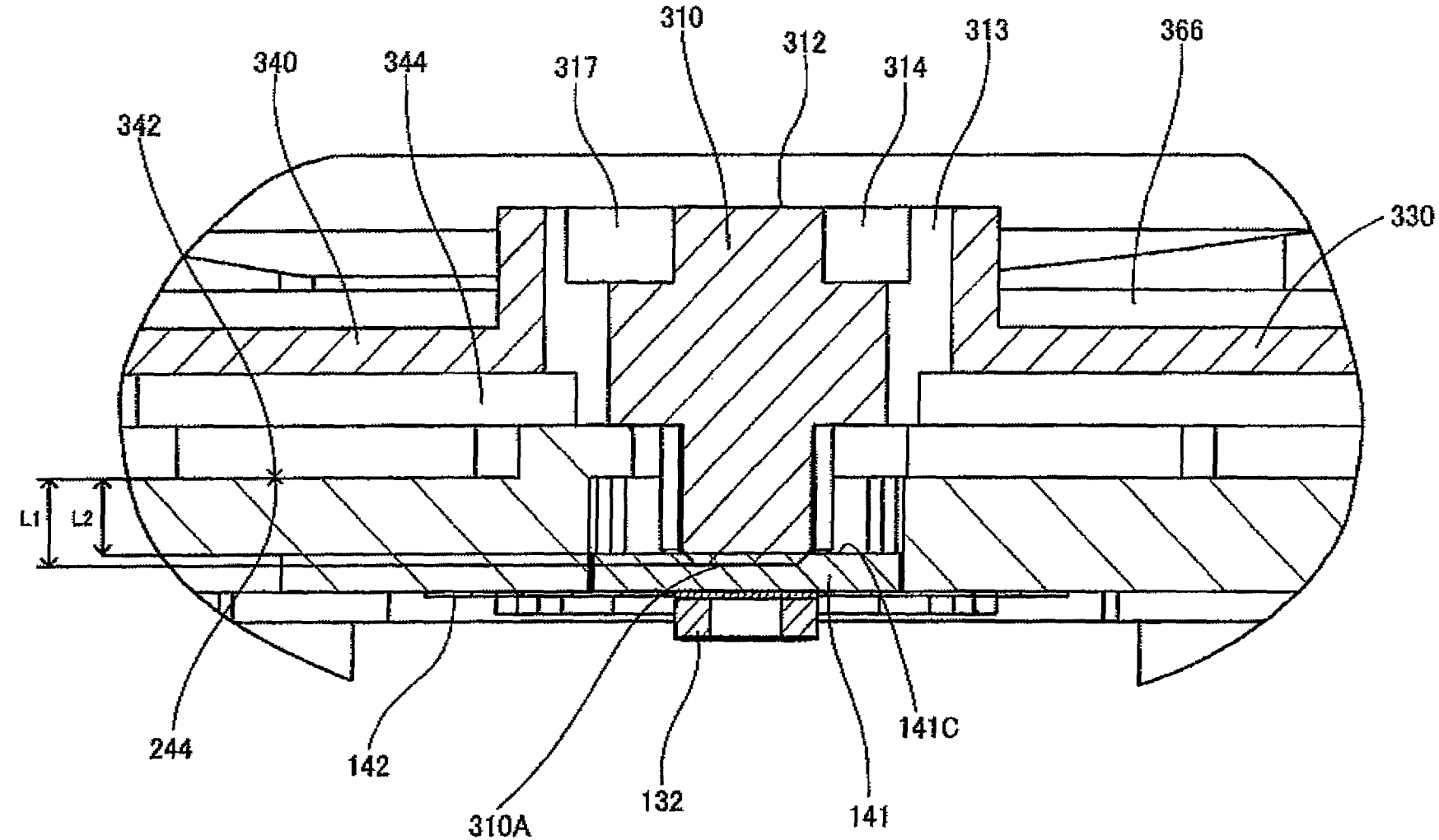
FIG. 14 is an enlarged view illustrating a B portion of FIG. 9.

The meaning of expression (1) will be described with reference to FIG. 14 which is an enlarged view illustrating a B portion of FIG. 9. In FIG. 14, L1>L2 means that the cavity sealing surface 310A of the pressure receiving plate 310 overlaps downward from the sealing surface 141C of the sensor base 141. Practically, as shown in FIG. 14, the pressure receiving plate 310 and the sensor base 141 do not overlap each other and the sensor base 141 is bent downward as much as an overlapping portion due to the flexibility of the sealing film 142, such that the cavity sealing surface 310A of the pressure receiving plate 310 is reliably in contact with the sealing surface 141C of the sensor base 141. Thus, an amplitude value of a remaining vibration waveform can be maintained below a defined value at the time of detecting the amount of remaining ink.

If the distances L1 and L2 are more specifically described, design satisfying the relationship of L0<L1<L0+L01 is realized assuming that a reference design value of the distances L1 and L2 is L0 and a maximum value of positive variation of the distance L1 is L01, and design satisfying the relationship of L0−L02<L2<L0 is realized assuming that a maximum value of negative variation of the distance L2 is −L02. Here, L02<L01.

In this case, the following expression (2) is satisfied.

$$L02<L1-L2<L01 \quad (2)$$

If expression (2) is satisfied, expression (1) is necessarily satisfied. That is, a difference between the distances L1 and L2 is preferably between an absolute value L2 of the maximum value of the negative variation of the distance L2 and the maximum value of the positive variation of the distance L1.

(Operations at an Initial Stage and at the Time of Liquid Detection)

At an initial stage when ink is introduced into the ink chamber 200, the movable member 300 is displaced by a biasing force of the biasing member 153, the sensor cavity sealing surface 310A of the pressure receiving plate 310 comes in contact with the surface 141C of the sensor base 141, and the diaphragm 156 is displaced to the position where the volume of the ink detection chamber 200 decreases. This state is shown in FIG. 15. When ink starts to be introduced into the ink detection chamber 200, the ink flows through the first and second passages, such that the sensor cavity 132A is filled with the ink, as shown in FIG. 15. If a bubble is generated in the sensor cavity 132A, the bubble is discharged through the second passage on the downstream side.

Figure 15:
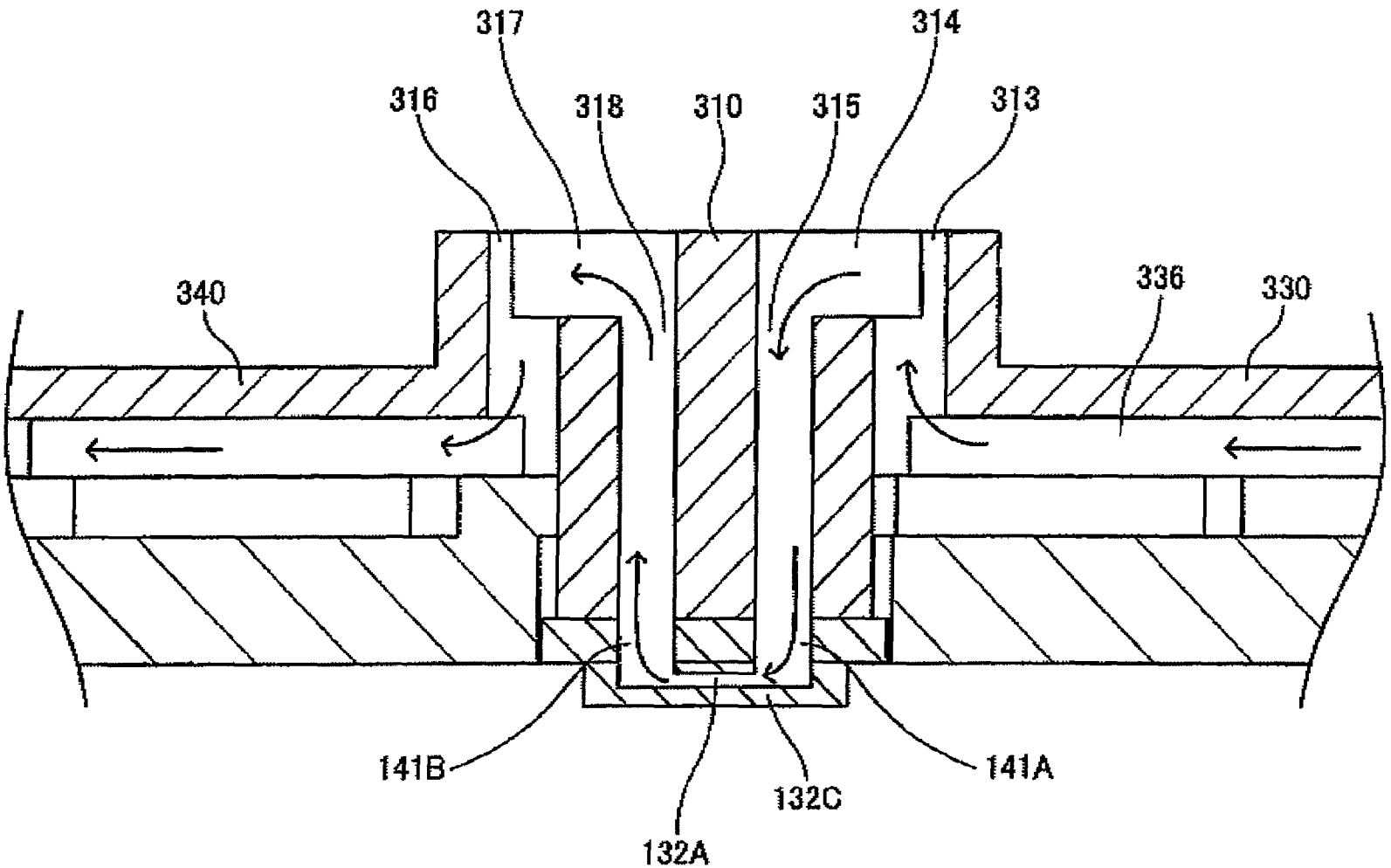
FIG. 15 is a cross-sectional view schematically illustrating an initial operation and an ink detection operation.

On the other hand, ink pressure within the ink detection chamber 200 is large before detection of a remaining ink, unlike the state shown in FIG. 15. Accordingly, the diaphragm 156 expands to increase the volume of the ink detection chamber 200. Then, the pressure receiving plate 310 is spaced apart from the surface 141C of the sensor base (detection-portion-mounted member) 141 against a biasing force of the biasing member 153. When the ink pressure becomes smaller than a predetermined value, the movable member 300 is displaced by the biasing force of the biasing member 153. As a result, the pressure receiving plate 310 is brought into contact with the surface 141C of the sensor base (detection-portion-mounted member) 141 and the diaphragm 156 is displaced to the position where the volume of the liquid detection chamber decreases, which is the same as the state shown in FIG. 15. When the pressure receiving plate 310 is spaced apart from the sensor base 141 such that the sensor cavity 132A is opened to the ink detection chamber 200, attenuation of a remaining vibration waveform is small. On the other hand, when the pressure receiving plate 310 is brought into contact with the sensor base 141 such that the sensor cavity 132A is blocked, attenuation of a remaining vibration waveform is large. Through the difference described above, liquid detection, such as the amount of remaining liquid and the pressure of liquid, based on the position of the movable member becomes possible.

(Method of Refilling an Ink Container With Ink)

This is a method of refilling the ink pack 107 with ink after ink contained in the ink pack 107 according to the present embodiment described above is lead out and the ink cartridge 21 is collected from the market.

In this method, ink is refilled through the ink lead-out member 109 shown in FIG. 3. Therefore, ink is introduced to the ink detection chamber 200 from the ink outlet 204 (refer to FIG. 8). At this time, the ink which remains in the sensor cavity 132A at the time of recovery is maintained in the sensor cavity 132A. Accordingly, it is not necessary to fill the sensor cavity 132A with ink at least through the second passages 344, 316, 317, and 318. That is, ink can be refilled from ink input 202 toward the ink pack 107 by causing ink to pass through the ink detection chamber 200 from the ink outlet 204 toward the ink inlet 202. In addition, since ink remaining in the sensor cavity 132A is not in contact with air, there occurs no problem concerning deterioration of ink.

While the present embodiment has been described in detail, it could be easily understood by one skilled in the art that various changes and modifications thereof could be made without departing from novel matters and effects of the invention. Therefore, such all modifications still fall within the scope of the invention. For example, in this specification or the drawings, a term which is described at least once together with different terns having a broader meaning or the same meaning can be replaced with the different terms in any parts of the specification or drawings.

In addition, for the purpose of liquid detection, for example, liquid pressure may be detected other than detection of the amount of remaining liquid.

Furthermore, a liquid detecting means is not limited to the piezoelectric detecting means. The point is that any kinds of means capable of detecting the displacement of the movable member 110, which is displaced by the liquid pressure, may be used. For example, an optical detecting means or the like may also be used.

In addition, application of the liquid container of the invention is not limited to the ink cartridge of an ink jet recording apparatus. For example, the liquid container may be applied to various kinds of liquid consuming apparatuses provided with liquid ejecting heads from which a small amount of liquid droplets are discharged.

For example, specific examples of the liquid consuming apparatus includes an apparatus provided with a color material ejecting head used to manufacture a color filter for a liquid crystal display or the like, an apparatus provided with a electrode material (conductive paste) ejecting head used to form an electrode of an organic EL display, a surface emission display (FED), or the like, an apparatus provided with a bioorganic material ejecting head used to manufacture a biochip, an apparatus provided with a sample ejecting head as a precision pipette, a textile printing apparatus, a microdispenser, and the like.

Furthermore, in this invention, liquid is preferably a material which can be ejected by the liquid consuming apparatus. A representative example of liquid is ink described in the above embodiment. Liquid may be a material, such as liquid crystal, which is not a material used to print a character or an image. In addition, in this invention, the liquid may be not only liquid as a state of a material but also a material obtained by mixing the liquid as a state of a material with a solid material, such as pigment or metallic particles.

This application claims priority from Japanese Patent Application Nos. filed on 2006-350224 filed on Dec. 26, 2006 and 2007-180754 filed on Jul. 10, 2007, the entire disclosure of which are expressly incorporated by reference herein.

What is claimed is:

1. A liquid detecting device comprising:

a liquid detection chamber which includes a liquid inlet, a liquid outlet, a flexible diaphragm that is displaced depending on liquid pressure between the liquid inlet and the liquid outlet, and a detection-portion-mounted member having one surface facing the diaphragm, and a volume of which changes with the liquid pressure;

a movable member provided within the liquid detection chamber;

a detection portion which is provided on the other surface of the detection-portion-mounted member and which includes a detection space portion that communicates with the liquid detection chamber and is separated from the liquid detection chamber by the detection-portion-mounted member, and a piezoelectric sensor that applies vibration to the detection space portion to detect a remaining vibration waveform according to the vibration; and a biasing member which biases the movable member movabely toward the detection-portion mounted member, wherein the movable member has a pressure receiving plate and two shafts formed to protrude from the pressure receiving plate, and the pressure receiving plate is attached to the diaphragm and faces the one surface of the detection-portion-mounted member, the diaphragm expands until a volume of the liquid detection chamber reaches a predetermined volume when the liquid pressure is a predetermined value, such that the pressure receiving plate is spaced apart from the one surface of the detection-portion-mounted member against a biasing force of the biasing member, the movable member causes the pressure receiving plate to come in contact with the one surface of the detection-portion-mounted member at an initial stage where liquid is introduced into the liquid detection chamber, and the diaphragm to be displaced to a position at which the volume of the liquid detection chamber is smaller than the predetermined volume at liquid detection time at which the liquid pressure becomes smaller than the predetermined value, by the biasing force of the biasing member, the movable member further includes a first passage, which guides the liquid from the liquid inlet to the detection space portion at the initial stage, and a second passage, which guides the liquid from the detection space portion to the liquid outlet at the initial stage, and the liquid detection chamber includes shaft receiving members, each of which is provided for positioning of each of the two shafts in a first direction of two perpendicular-axes directions of a two-dimensional plane parallel to the one surface of the detection-portion-mounted member, and facing members, each of which is positioned facing a front end surface of each of the two shafts in a second direction of the two perpendicular axes.

2. The liquid detecting device according to claim 1, wherein the piezoelectric sensor detects an amplitude value of the remaining vibration waveform based on a distance between the piezoelectric sensor and the pressure receiving plate.

3. The liquid detecting device according to claim 2, wherein two through holes which communicate with the liquid detection chamber and the detection space portion, respectively, are formed in the detection-portion-mounted member.

4. The liquid detecting device according to claim 3, wherein the movable member includes:

an upstream-side member which is formed to extend from the pressure receiving plate toward a side of the liquid inlet along the first direction of the two perpendicular axes; and a downstream-side member which is formed to extend from the pressure receiving plate toward a side of the liquid outlet along the first direction of the two perpendicular axes, the first passage is formed in the upstream-side member and the pressure receiving plate and guides the liquid to the detection space portion through one through hole formed from the side of the liquid inlet to the detection-portion-mounted member, and the second passage is formed in the downstream-side member and the pressure receiving plate and guides the liquid to the liquid outlet through the other through hole formed from the detection space portion to the side of the detection-portion-mounted member.

5. The liquid detecting device according to claim 4, wherein the liquid detection chamber has a sealing surface which is in contact with the downstream-side member at the initial stage to thereby seal a part of the second passage.

6. The liquid detecting device according to claim 1, wherein the liquid detection chamber has an opening formed at a central position thereof so as to keep positioning the detection-portion-mounted member while exposing the detection-portion-mounted member, and the two perpendicular axes have an intersection point at a position matching the central position of the liquid detection chamber.

7. The liquid detecting device according to claim 1, wherein each of the shaft receiving member includes two standing members which stand up from the liquid detection chamber on both sides of each of the two shafts, the two standing members are formed such that a base-end-side distance therebetween is smaller than a free-end-side distance therebetween, and each of the two shafts is positioned at the base end side of the two standing members when the pressure receiving plate comes in contact with the one surface of the detection-portion-mounted member.

8. The liquid detecting device according to claim 1, wherein the front end surface of each of the two shafts is curved.

9. The liquid detecting device according to any one of claims 1 to 8, wherein a recess in which the movable member is accommodated is formed in the liquid detection chamber, and the facing member is formed in a part of an inside wall that forms the recess.

10. The liquid detecting device according to claim 9, wherein the facing member is formed by making the inside wall flat by a predetermined width along the first direction of the two perpendicular axes.

11. A liquid container comprising:

a liquid containing body that contains liquid therein; and the liquid detecting device according to claim 1 which communicates with the liquid containing body and in which the liquid contained in the liquid containing body is supplied to the liquid inlet.

12. A liquid refilling method for refilling the liquid containing body of the liquid container collected form a market after liquid contained in the liquid containing body is lead out, comprising:

introducing liquid from the liquid outlet;

causing the liquid to pass from the liquid outlet toward the liquid inlet in the liquid detection chamber, without passing through at least the second passage, while holding liquid which remains in the detection space portion at the time of collection; and refilling with liquid from the liquid inlet of the liquid detecting device toward the liquid containing body.

13. A liquid container comprising:

a liquid containing portion for containing liquid therein;

a unit case, including a liquid inlet communicating with the liquid containing portion, a liquid outlet for supplying the liquid outside, a flexible diaphragm that covers an upper opening of the unit case and that is displaceable depending on liquid pressure between the liquid inlet and the liquid outlet;

a movable member attached to the flexible diaphragm and that has a pair of shafts formed to protrude from opposite sides of the movable member;

a sensor assembly attached to a bottom opening formed in a bottom plate of the unit case and used for detecting that the liquid in the liquid containing portion is exhausted to a predetermined amount; and a pair of shaft receiving portions that is provided on the unit case for receiving the pair of the shafts to fix the movable member in a predetermined position in an initial state where the liquid has not flowed from the liquid inlet to the detection portion.

14. The liquid container according to claim 13, each of the pair of shaft receiving portions includes two standing members arranged to fix the shaft therebetween.

15. The liquid container according to claim 13, wherein inner faces of the unit case corresponding to leading ends of the pair of the shafts are formed to be flat so as to regulate a movement of the pair of the shafts.

* * * * *